US008328328B2

(12) United States Patent
DaCunha

(10) Patent No.: US 8,328,328 B2
(45) Date of Patent: Dec. 11, 2012

(54) DEVICE FOR MITIGATING THE PRODUCTION/REMOVAL OF PARTICULATE MATTER FROM A SUBSTRATE/MAILPIECE ENVELOPE

(75) Inventor: Steven J. DaCunha, West Hartford, CT (US)

(73) Assignee: Pitney Bowes Inc., Stamford, CT (US)

( * ) Notice: Subject to any disclaimer, the term of this patent is extended or adjusted under 35 U.S.C. 154(b) by 269 days.

(21) Appl. No.: 12/791,487

(22) Filed: Jun. 1, 2010

(65) Prior Publication Data

US 2011/0292119 A1 Dec. 1, 2011

(51) Int. Cl.
*B41J 23/00* (2006.01)

(52) U.S. Cl. ..... 347/37

(58) Field of Classification Search ..... 347/8; 271/264
See application file for complete search history.

(56) References Cited

U.S. PATENT DOCUMENTS

| | | | | |
|---|---|---|---|---|
| 4,821,049 | A | 4/1989 | Eckl | |
| 5,913,627 | A | 6/1999 | Freeman et al. | |
| 2008/0218547 | A1* | 9/2008 | Takamiya et al. | 347/12 |
| 2011/0157278 | A1* | 6/2011 | Gulvin et al. | 347/45 |

FOREIGN PATENT DOCUMENTS

| | | | |
|---|---|---|---|
| EP | 0783977 | A2 | 7/1999 |
| EP | 2226197 | A1 | 9/2010 |

OTHER PUBLICATIONS

The European Search Report for European Patent Application No. 11 168 413.0.

* cited by examiner

*Primary Examiner* — Matthew Luu
*Assistant Examiner* — Lisa M Solomon
(74) *Attorney, Agent, or Firm* — Brian A. Collins; Charles R. Malandra, Jr.; Steven J. Shapiro

(57) ABSTRACT

A registration device for use in combination with an array of print head nozzles and operative to deposit ink on a substrate material. The registration device is operative to maintain a prescribed separation distance between an array of print head nozzles and a substrate material during print operations and includes a registration surface which opposes a face surface of the substrate material and is textured to define a plurality of contact points. The contact points are substantially evenly distributed over, and engage, the face surface of the substrate material, to reduce the total surface area in contact with the substrate material and the particulate matter which may be shed from, and/or produced by frictional engagement with, the substrate material.

14 Claims, 4 Drawing Sheets

DEVICE FOR MITIGATING THE PRODUCTION/REMOVAL OF PARTICULATE MATTER FROM A SUBSTRATE/MAILPIECE ENVELOPE

TECHNICAL FIELD

The present invention relates to a registration device for use in a substrate print station and, more particularly, to a new and useful registration device for mitigating the production/removal of particulate matter, i.e., dust and debris, from the substrate material/mailpiece envelope as it engages a registration surface during print operations.

BACKGROUND OF THE INVENTION

Mailpiece creation systems such as mailpiece inserters are typically used by organizations such as banks, insurance companies, and utility companies to periodically produce a large volume of mailpieces, e.g., monthly billing or shareholders income/dividend statements. In many respects, mailpiece inserters are analogous to automated assembly equipment inasmuch as sheets, inserts and envelopes are conveyed along a feed path and assembled in or at various modules of the mailpiece inserter. That is, the various modules work cooperatively to process the sheets until a finished mailpiece is produced.

A mailpiece inserter includes a variety of apparatus/modules for conveying and processing a substrate/sheet material along the feed path. Commonly mailpiece inserters include apparatus/modules for (i) feeding and singulating printed content material in a "feeder module", (ii) accumulating the content material to form a multi-sheet collation in an "accumulator", (iii) folding the content material to produce a variety of fold configurations such as a C-fold, Z-fold, bi-fold and gate fold, in a "folder", (iv) feeding mailpiece inserts such as coupons, brochures, and pamphlets, in combination with the content material, in a "chassis module" (v) inserting the folded/unfolded and/or nested content material into an envelope in an "envelope inserter", (vi) sealing the filled envelope in "sealing module" (vii) printing recipient/return addresses and/or postage indicia on the face of the mailpiece envelope at a "print station" and (viii) controlling the flow and speed of the content material at various locations along the feed path of the mailpiece inserter by a series of "buffer stations". In addition to these commonly employed apparatus/modules, mailpiece inserter may also include other modules for (i) binding/stitching an edge of sheet material to form a bound collation, i.e., via a stitcher/stapler module, and (ii) reversing the orientation of the substrate/sheet material, via a "sheet inverter" to print information on an opposite side of the sheet/content material.

With respect to the printing station, it is common to register a face surface of each mailpiece with a registration plate such that an array of print heads may print information such as destination and return addresses on the face of each mailpiece. More specifically, the registration plate includes an aperture for accepting a stepped array of print head nozzles. The thickness of the registration plate provides a threshold "stand-off" dimension from the face surface of each mailpiece to each of the print head nozzles such that ink droplets may be precisely deposited.

Furthermore, the array of print heads and registration plate are typically disposed over, and/or in opposed relation to, an underlying conveyance system such as one or more conveyor belts. Mailpieces are conveyed along the belt(s), move under the registration plate and passed by the print head nozzles as ink is deposited. To ensure that mailpieces slide smoothly beneath the registration plate, i.e., without jamming, the spacing between the underlying conveyance system, e.g., the conveyance belt (s), and the registration plate must be closely controlled. That is, with each mail run/print job performed by the print module, the necessary clearance gap must be established based upon the anticipated thickness of mailpieces being processed. Alternatively, the underlying conveyance system/belt may be compliant to allow envelopes of variable thickness dimension move under the registration plate while the deck the of conveyance system/belt is displaced by the geometric variation in envelope thickness.

Furthermore, as a mailpiece passes the registration plate, particulate matter, which may have collected on an envelope during pre-processing, can be disturbed and become airborne due to engagement of the envelope with the registration plate. Additionally, the frictional engagement with the registration plate may produce additional dust and debris. As more particulate matter is disturbed/removed/produced, the print station must perform additional purge cycles to clear the print head nozzles of dust and debris. As a result, the mailpiece inserter is halted, or momentarily/temporarily discontinued, to allow the purge cycle to clear/clean the print head nozzles. While such purge cycles must be tolerated to permit smooth operation of the print station, the down time is unproductive and costly to the operator. Furthermore, inasmuch as the ink used to purge the print head nozzles is costly, it is desirable to minimize the number of purge cycles that a print station performs to minimize the cost of the ink consumed.

A need, therefore, exists for a print station which mitigates the removal/production of particulate matter to optimize print station/inserter efficiency. Such increased efficiency may be achieved by reducing the number purge cycles necessary to clear/clean the print head nozzles and the cost associated with lost productivity and ink consumption.

SUMMARY OF THE INVENTION

A registration device is provided for use in combination with an array of print head nozzles operative to deposit ink on a substrate material. The registration device is operative to maintain a prescribed separation distance between an array of print head nozzles and a substrate material during print operations and includes a registration surface which opposes a face surface of the substrate material and is textured to define a plurality of contact points. The contact points are substantially evenly distributed over, and engage, the face surface of the substrate material, to reduce the total surface area in contact with the substrate material and the particulate matter which may be shed from, and/or produced by frictional engagement with, the substrate material.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

DETAILED DESCRIPTION OF THE INVENTION

A registration device and print station are described for printing information on a mailpiece envelope such as a destination address, return address and postage indicia for delivery of the mailpiece. While the invention is described in the context of a mailpiece inserter, the registration device and print station described herein are applicable to any printer wherein a substrate material is registered against a registration device for maintaining a prescribed separation distance between an array of print head nozzles and a substrate material during print operations. Consequently, the detailed description and illustrations are merely indicative of an embodiment of the invention, and, accordingly, the invention should be broadly interpreted in accordance with the appended claims.

Figure 1:
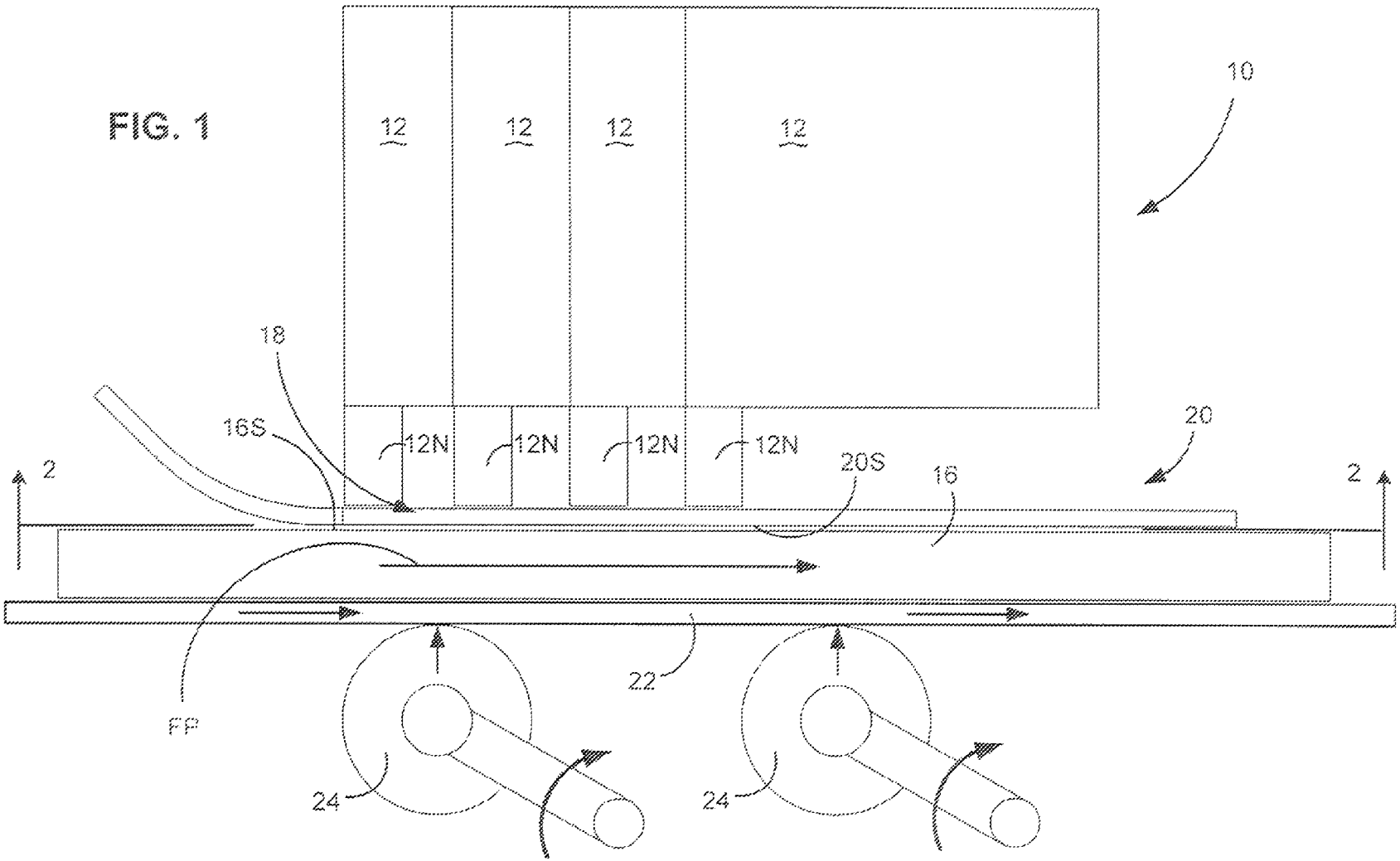
FIG. 1 is a side view of a registration device and print station according to the present invention wherein an array of print heads is disposed in combination with the registration device to deposit ink on a face surface of a mailpiece envelope.

FIG. 1 depicts a side view of a print station 10 having a plurality of print heads 12. Each print head 12 deposits ink, i.e., prints, on a face surface 14 of a substrate material 16 (e.g., such as a mailpiece envelope) as the substrate material 16 is conveyed through the print station 10. Inasmuch as the invention is principally described in the context of a print station 12 for a mailpiece inserter, the term mailpiece envelope 16 will, hereinafter, be used to mean any sheet and/or substrate material. Each of the print heads 12 includes one or more rows of print head nozzles 12N which deposit ink through an aperture/opening 18 in a registration device 20.

The registration device 20 is disposed in combination with the print heads 12 and functions to maintain a prescribed separation distance between a face surface 16S of the mailpiece envelope 16 and each of the print head nozzles 12N. The separation distance ensures the efficacy of print operations inasmuch as the deposited ink requires a certain stand-off distance, i.e., spacing from the exit of the nozzles 12N to the face surface 14, to be deposited at a precise location on the face surface 16S of the mailpiece envelope 16.

The mailpiece envelope 16 is conveyed through the print station 10 by a conventional transport system such as a conveyor belt 22 which may be supported on, or by, a series of spring-biased rollers 24. The spring-biased rollers 24 urge the conveyor belt 22, and consequently, mailpiece envelope 16, upwardly toward a registration surface 20S of the registration device 20. By urging the envelope 16 upwardly against the registration surface 20S, the separation distance between the print head nozzles 12N and the top face surface 20S of the mailpiece envelope may be accurately controlled. As a consequence, print quality is accurately maintained for optimum print performance.

In FIGS. 1 through 4, the registration surface 20S opposes and engages the face surface 16S (see FIG. 1) of the envelope 16 as the conveyor belt 22 transports the envelope 16 beneath the print head nozzles 12N of the print station 12. The registration surface 20S is textured to contact the face surface 16S of the mailpiece envelope 16 at multiple points, or regions, along the face surface 16S. The registration surface 20S defines a plurality of contact surfaces 30 which are substantially evenly distributed across the registration surface 20S and a plurality of non-contact regions 32 disposed therebetween. The contact surfaces 30 are (i) raised, (ii) have a substantially convex or arcuate contour, and, (iii) are operative to effect bridging of the mailpiece envelope 16, i.e., across the non-contact regions 32, such that registration surface 20S does not frictionally engage the face surface 16S of the mailpiece envelope at these regions 32.

As will be discussed in greater detail hereinafter, the textured surface, i.e., which includes the contact surfaces 30 and non-contact regions 32, reduces the surface area in contact with the face surface 16S of the mailpiece envelope 16, i.e., as compared to the total surface area of a purely planar/flat registration surface employed in prior art registration devices. That is, the textured surface of the registration device 20 mitigates particulate matter removed/shed from the mailpiece envelope 16 by minimizing the friction and/or profile drag developed between the registration surface 20S of the registration device 20 and the face surface 16S of the mailpiece envelope 16.

Figure 2:
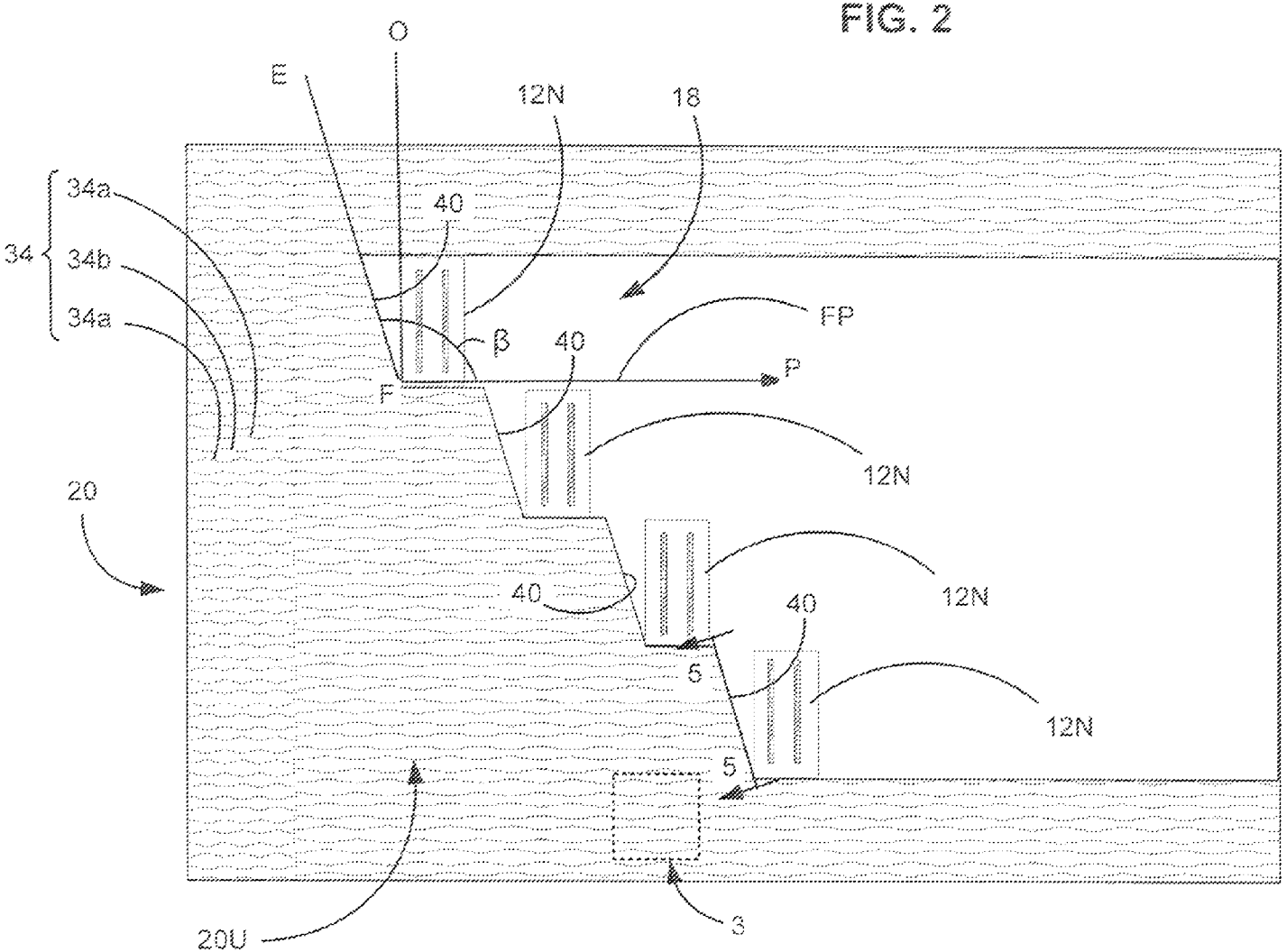
FIG. 2 is a view taken substantially along line 2-2 of FIG. 1 depicting a textured surface of the registration device which includes a plurality of raised contact surfaces and at least one upstream edge which is inclined relative to a line orthogonal to the feed path of the mailpiece envelope.
Figure 3:
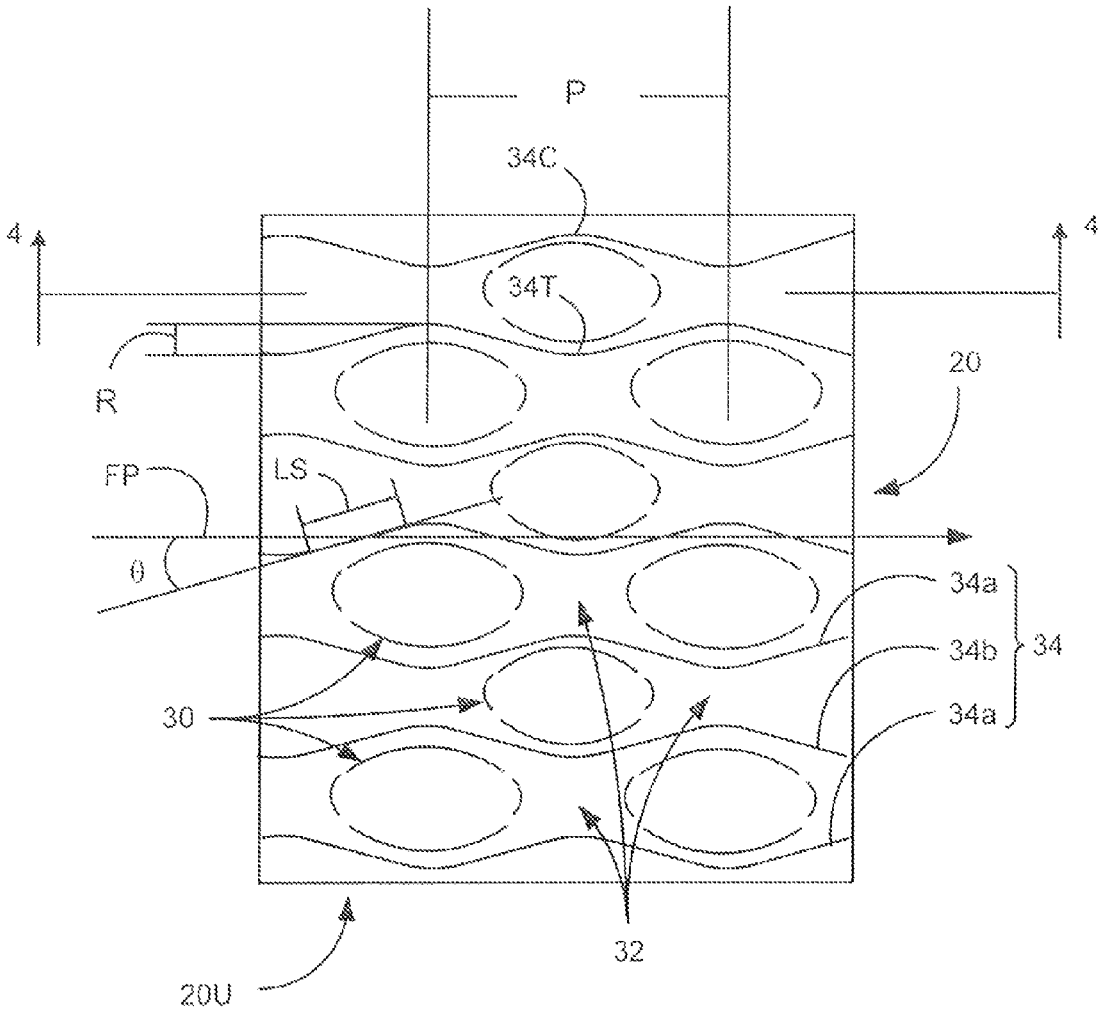
FIG. 3 is an enlarged view of the textured registration surface within a region 3 of FIG. 2, wherein the contact surfaces are defined by a plurality of serpentine-shaped surface grooves which are out-of-phase to stagger the arrangement of contact surfaces.
Figure 4:
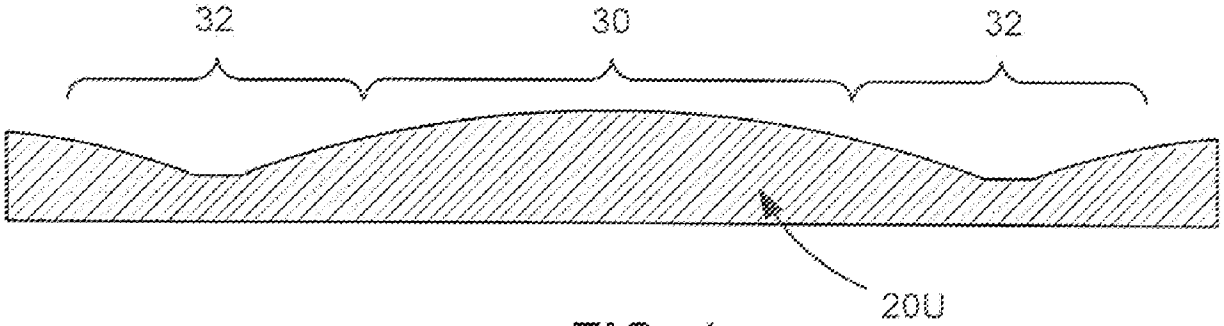
FIG. 4 is an enlarged cross sectional view taken substantially along line 4-4 of FIG. 3 depicting a convex or arcuate surface of each contact surface.

The contact surfaces 30 may be produced by plurality of serpentine-shaped grooves 34 which extend in a direction substantially parallel to the feed path of the mailpiece envelope 16 (shown in the direction of arrow FP in FIG. 3). The grooves 34 may be aligned, i.e., in phase, or staggered, i.e., out-of-phase, relative to the feed path FP of the mailpiece envelope 16. FIGS. 2 and 3 show the grooves in a staggered pattern such that the crest 34C of one groove 34*a* aligns a trough 34T of an adjacent groove 34*b*. Furthermore, by aligning grooves 34 in an out-of-phase arrangement, the contact surfaces 30 are staggered from one, or a first, row of tandem contact surfaces 30 to an adjacent, or second, row of tandem contact surfaces 30. Moreover, as a consequence of the shape and alignment of the grooves 34, each of the contact surfaces 30 define an elongate-diamond or elliptical shape (best seen in FIG. 3).

Upon examination of various patterns, shapes and sizes, it has been determined that serpentine-shaped grooves 34 having a pitch P (i.e., a distance or length between a pair of adjacent crests 34C or a pair of adjacent troughs 34T), of between about three-eights inches (3/8") to about one-quarter inches (1/4"), and a rise R (i.e., a distance or height from a minimum depth along one trough 34T to a maximum height along an adjacent crest 34C) of between about five thirty-seconds inches (5/34") to about seven thirty-seconds inches (7/34"), produces favorable results. Moreover, a groove 34 having a substantially linear segment LS (i.e., a segment shown in FIG. 3 connecting curvilinear segments at the apex of one crest 34C and the base of an adjacent trough 34T) such as the serpentine groove shown in the described embodiment, defines a lead angle θ between the linear segment LS and the feed path FP. In the described embodiment the illustrated embodiment, the lead angle θ is between about five degrees (5°) to about fifteen degrees (15°) yields favorable results. In the described embodiment, a textured registration surface 20S of the type described above may be fabricated from 304 polished stainless steel sheets having a 5-SM surface pattern available from RIMEX Metals Inc. located in the town of Edison, State of New Jersey.

Thus far in our discussion, the surface texture of the registration device 20 has been discussed to mitigate particulate matter produced/removed/shed from the mailpiece envelope 16. Yet another characteristic of the registration device 20, which synergistically reduces the particulate matter, relates to the shape of the opening 18, and, more particularly, to the shape or angle of the edges 40 upstream of each of the print head nozzles 12N. Referring back to FIG. 2, the edges 40 define an obtuse angle β relative to the feed path FP of the mailpiece envelope 16 (i.e., the angle produced between line segments FP and FE). More particularly, in the described embodiment, the obtuse angle β is greater than about one-hundred and five degrees) (105°) relative to the feed path of the substrate material. More preferably, the obtuse angle β is greater than about ninety-five degrees (95°) relative to the feed path of the substrate material.

Figure 5:
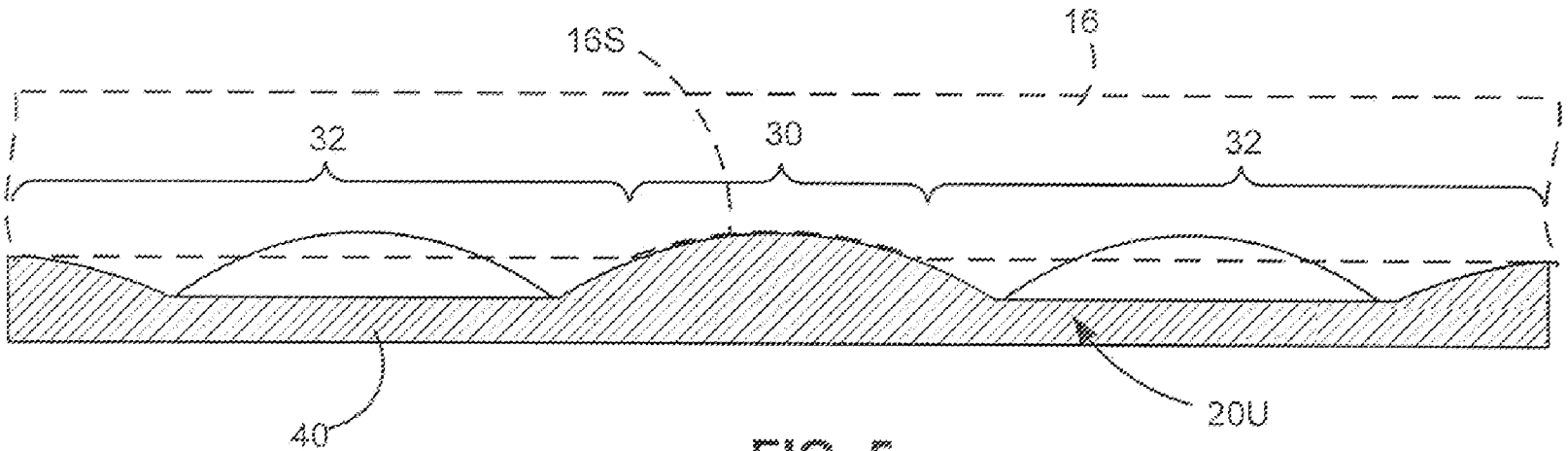
FIG. 5 is an enlarged cross sectional view taken substantially along line 5-5 of FIG. 3 depicting an upstream edge to emphasize the effect of severing/cutting the textured surface of the registration device along an edge which is off-axis relative to a line orthogonal to the feed path of the mailpiece envelope.

The significance of producing/cutting the upstream edges 40 along an incline will be appreciated by examining FIG. 5. Therein, the registration surface 20S has been cut to produce an edge 40, i.e., along the lead angle β, wherein several of the contact surfaces 30 are severed at a point corresponding, or proximal, to the apex of a respective one of the contact surfaces 30. Additionally, the registration surface 20S has been cut such that the edge 40 is severed at a point corresponding to the non-contact areas 32, i.e., between adjacent contact surfaces 30.

In as much a discontinuous edge, or portion, of the registration device 20 has a tendency to whip, or disturb, the surface 16S of a mailpiece envelope 16 more thoroughly, than a continuous surface, an edge 40 having fewer contact surfaces 30 and more non-contact regions 32 will shed/remove less particulate matter from the face surface 16S of the mailpiece envelope 16 than one with more contact surfaces and less non-contact regions 32. By cutting the upstream edge 40 at an angle relative to a line FO orthogonal to the feed path, the edge 40 will be severed at several locations along the surface 20, however, at least one location will correspond to at least one non-contact region 32 of the surface 20S. Consequently, this configuration, i.e., an edge which is cut along an incline, or at an obtuse angle relative to the feed path, ensures that the edge 40 will produce less particulate matter by reducing its tendency to whip or disturb the surface 16S of the mailpiece envelope 16.

In summary, the present invention provides a registration device for a print station which mitigates the removal/production of particulate matter to optimize print station/inserter efficiency. The registration surface minimizes the disturbance of existing particulate matter by reducing the surface area contacting the surface of a substrate material/mailpiece envelope. By cutting an opening, through which ink is deposited, along an incline (i.e., at an obtuse angle relative to the feed path, or off-axis relative to a line orthogonal to the feed path) the tendency of the edge to disturb or remove particulate mater is also reduced. Increased efficiency is achieved by reducing the number purge cycles necessary to clear/clean the print head nozzles and the cost associated with lost productivity and ink consumption.

It is to be understood that all of the present figures, and the accompanying narrative discussions of preferred embodiments, do not purport to be completely rigorous treatments of the methods and systems under consideration. For example, while the invention describes an interval of time for completing a phase of sorting operations, it should be appreciated that the processing time may differ. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, methods of escorting and storing individual mailpieces and in various configurations which need not be further elaborated herein.

The invention claimed is:

1. A registration device operative to maintain a prescribed separation distance between an array of print head nozzles and a substrate material during print operations, the registration device comprising:

a registration surface opposing a face surface of the substrate material and being textured to define a plurality of contact surfaces substantially evenly distributed over the face surface of the substrate material, the contact surfaces reducing a surface area in contact with the substrate material to mitigate particulate matter shed from the substrate material;

wherein the contact surfaces are defined by a plurality of grooves oriented substantially parallel to a feed path of the substrate material, each of the grooves defining a substantially serpentine-shape and wherein adjacent grooves are out-of-phase such that the contact surfaces are staggered from one row of contact surfaces to an adjacent row of contact surfaces.

2. The registration device according to claim 1 wherein the contact surfaces have a substantially arcuate shaped surface contour.

3. The registration device according to claim 1 wherein the contact surfaces have a substantially elongate diamond shape.

4. The registration device according to claim 1 wherein each groove defines a lead angle within a range of between about five degrees (5°) to about fifteen degrees (15°).

5. The registration device according to claim 1 wherein the registration surface includes an opening through which ink is deposited, the opening having an edge upstream of at least one of the nozzles and wherein the upstream edge defines an obtuse angle relative to the feed path of the substrate material.

6. The registration device according to claim 5 wherein the obtuse angle is greater than about one-hundred and five degrees (105°) relative to the feed path of the substrate material.

7. The registration device accord to claim 6 wherein the obtuse angle is greater than about ninety-five degrees (95°) relative to the feed path of the substrate material.

8. A print station for a mailpiece inserter comprising:

an array of print head nozzles operative to deposit ink on a mailpiece envelope being conveyed along a feed path; and a registration plate spatially positioned relative to the print head nozzles and operative to maintain a prescribed separation distance between the registration plate and the print head nozzles, the registration plate having a registration surface opposing a top face surface of the mailpiece envelope and being textured to define a plurality of contact surfaces substantially evenly-distributed over, and engaging, the face surface of the mailpiece envelope, the contact surfaces, furthermore, defined by a plurality of grooves having a substantially serpentine shape and oriented substantially parallel to the feed path of the mailpiece envelope, the adjacent grooves being out-of-phase such that contact surfaces of one row are staggered relative to the contact surfaces of an adjacent row, and wherein the contact points reduce a surface area in contact with the substrate material to mitigate particulate matter shed from the substrate material.

9. The print station according to claim 8 wherein the contact surfaces have a substantially arcuate shaped surface contour.

10. The print station according to claim 8 wherein the contact surfaces have a substantially elongate diamond shape.

11. The print station according to claim 8 wherein each groove defines a lead angle within a range of between about five degrees (5°) to about fifteen degrees (15°).

12. The print station according to claim 8 wherein the registration surface includes an opening through which ink is deposited, the opening having an edge upstream of at least one of the nozzles and wherein the upstream defines an obtuse angle relative to the feed path of the mailpiece envelope.

13. The registration device according to claim 12 wherein the obtuse angle is greater than about one-hundred and five degrees (105°) relative to the feed path of the mailpiece envelope.

14. The registration device accord to claim 13 wherein the obtuse angle is greater than about ninety-five degrees (95°) relative to the feed path of the mailpiece envelope.

* * * * *